US007802695B2

(12) United States Patent
Baker et al.

(10) Patent No.: US 7,802,695 B2
(45) **Date of Patent: *Sep. 28, 2010**

(54) LIDDED CONTAINER WITH LINEAR BRIM SEGMENTS AND MEDIAL SEALING BEADS

(75) Inventors: Loren G. Baker, Saylorsburg, PA (US); Jonathan E. Rush, Mount Bethel, PA (US); Rebecca E. Whitmore, Chilton, WI (US); Gerald J. Van Handel, Neenah, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 190 days.

This patent is subject to a terminal disclaimer.

(21) Appl. No.: 11/851,810

(22) Filed: Sep. 7, 2007

(65) Prior Publication Data

US 2007/0295741 A1 Dec. 27, 2007

Related U.S. Application Data

(63) Continuation of application No. 10/751,786, filed on Jan. 5, 2004, now abandoned, which is a continuation-in-part of application No. 10/456,207, filed on Jun. 6, 2003, now abandoned.

(60) Provisional application No. 60/389,533, filed on Jun. 18, 2002.

(51) Int. Cl.
*B65D 43/14* (2006.01)
*B65D 21/02* (2006.01)

(52) U.S. Cl. ..... 220/835; 220/23.4

(58) Field of Classification Search ..... 220/4.22, 220/4.23, 4.26, 23.4, 784, 835
See application file for complete search history.

(56) References Cited

U.S. PATENT DOCUMENTS

| | | | |
|---|---|---|---|
| 1,941,050 | A | 12/1933 | Punte |
| 2,302,045 | A | 11/1942 | Neumann et al. |
| 2,825,450 | A | 3/1958 | Lambert |
| 3,021,001 | A | 2/1962 | Donofrio |
| 3,054,679 | A | 9/1962 | Bradford |
| 3,115,266 | A | 12/1963 | Poupitch |
| 3,389,825 | A | 6/1968 | Whiteford |

(Continued)

FOREIGN PATENT DOCUMENTS

| | | |
|---|---|---|
| CH | 619665 | 10/1980 |

(Continued)

OTHER PUBLICATIONS

Throne, Thermoforming, 1987, pp. 21-29, Hanser Publishers, Munich, Germany.

(Continued)

*Primary Examiner*—Harry A Grosso

(57) ABSTRACT

An improved lidded container includes a receptacle portion with a brim having a plurality of lateral substantially straight brim wall segments provided with medial sealing beads extending between corners of the brim. The medial sealing beads are characterized in that they project away from the respective walls upon which they are disposed a maximum distance at a central portion of the wall and the medial sealing beads extend over a major portion of the length of the lateral sealing wall upon which they are disposed. Most preferably, the beads are tangent with and terminate at rounded corners between the wall segments.

17 Claims, 4 Drawing Sheets

U.S. PATENT DOCUMENTS

| | | | |
|---|---|---|---|
| 3,420,431 | A | 1/1969 | Donovan |
| 3,448,888 | A | 6/1969 | Smith et al. |
| 3,647,055 | A | 3/1972 | Pfaff |
| 3,715,856 | A | 2/1973 | Borel |
| 3,757,983 | A | 9/1973 | McCarthy |
| 4,054,207 | A | 10/1977 | Lazure et al. |
| 4,105,121 | A | 8/1978 | Mascetti |
| 4,215,797 | A | 8/1980 | Chen |
| 4,296,863 | A | 10/1981 | Stokkers |
| 4,398,634 | A | 8/1983 | McClosky |
| 4,421,244 | A | 12/1983 | Van Melle |
| 4,593,819 | A | 6/1986 | Will |
| 4,753,766 | A | 6/1988 | Pinsolle et al. |
| 4,798,133 | A | 1/1989 | Johnson |
| 4,829,006 | A | 5/1989 | Smith et al. |
| 4,875,620 | A | 10/1989 | Lane, Sr. |
| 5,012,971 | A | 5/1991 | Cozzi et al. |
| 5,024,067 | A | 6/1991 | Maier, II |
| 5,037,000 | A | 8/1991 | Selame |
| 5,160,767 | A | 11/1992 | Genske et al. |
| 5,221,040 | A | 6/1993 | Sorenson |
| 5,300,748 | A | 4/1994 | Colombo |
| 5,320,279 | A | 6/1994 | Giblin et al. |
| 5,332,147 | A | 7/1994 | Sorenson |
| 5,334,272 | A | 8/1994 | Takata et al. |
| 5,366,104 | A | 11/1994 | Armstrong |
| 5,377,860 | A | 1/1995 | Littlejohn et al. |
| 5,398,068 | A | 3/1995 | Liu et al. |
| 5,409,127 | A | 4/1995 | Strafford et al. |
| 5,417,365 | A | 5/1995 | Lindsay |
| 5,456,379 | A | 10/1995 | Krupa et al. |
| 5,531,349 | A | 7/1996 | Wojcik et al. |
| 5,543,104 | A | 8/1996 | Stratford et al. |
| 5,584,408 | A | 12/1996 | Orkisz |
| 5,702,017 | A | 12/1997 | Gonclaves |
| 5,720,406 | A | 2/1998 | Fassbind et al. |
| 5,722,553 | A | 3/1998 | Hovatter |
| 5,904,263 | A | 5/1999 | St. Pierre et al. |
| 5,938,068 | A | 8/1999 | Atkins et al. |
| 5,979,690 | A | 11/1999 | Hartley et al. |
| 6,000,535 | A | 12/1999 | Berk et al. |
| 6,032,827 | A | 3/2000 | Zettle et al. |
| 6,047,819 | A | 4/2000 | Borst et al. |
| 6,076,698 | A | 6/2000 | Magidson |
| 6,211,500 | B1 | 4/2001 | McCarthy et al. |
| 6,211,501 | B1 | 4/2001 | Cochran, II et al. |
| 6,629,834 | B2 | 10/2003 | Cargile et al. |
| 6,805,659 | B2 | 10/2004 | Bohrer |
| 2001/0052479 | A1 | 12/2001 | Gaffney et al. |
| 2002/0037378 | A1 | 3/2002 | Littlejohn et al. |
| 2002/0088737 | A1 | 7/2002 | Stepp |
| 2003/0141218 | A1 | 7/2003 | Stephens et al. |
| 2003/0185948 | A1 | 10/2003 | Garwood |
| 2003/0230582 | A1 | 12/2003 | Whitmore et al. |
| 2004/0164076 | A1 | 8/2004 | Baker et al. |
| 2005/0011898 | A1 | 1/2005 | Van Handel et al. |

FOREIGN PATENT DOCUMENTS

| | | | |
|---|---|---|---|
| DE | 2444416 | A1 | 4/1976 |
| DE | 2653906 | A1 | 6/1978 |
| DE | 10012364 | A1 | 9/2001 |
| EP | 0275102 | A2 | 7/1988 |
| EP | 0284349 | A2 | 9/1988 |
| EP | 0348142 | A2 | 12/1989 |
| EP | 0412029 | A1 | 2/1991 |
| EP | 0605082 | A1 | 7/1994 |
| EP | 0841150 | A2 | 5/1998 |
| FR | 1278149 | | 12/1961 |
| FR | 1392947 | | 2/1965 |
| FR | 2763314 | A1 | 11/1998 |
| GB | 649541 | | 1/1951 |
| GB | 2156658 | A | 10/1985 |
| RU | 19027 | U1 | 8/2001 |
| WO | 03/106276 | A1 | 12/2003 |
| WO | 2005/068307 | A2 | 7/2005 |

OTHER PUBLICATIONS

European Patent Office, International Search Report of the International Searching Authority for PCT/US03/17910, mailing date Sep. 29, 2003.

European Patent Office, International Search Report and Written Opinion of the International Searching Authority for PCT/US2004/043045, mailing date Mar. 17, 2005.

European Patent Office, International Search Report and Written Opinion of the International Searching Authority for PCT/US2005/000240, mailing date Jun. 28, 2005.

Decision of granting a patent for invention for Russian Application No. 2006128604, mailing date Feb. 19, 2009.

LIDDED CONTAINER WITH LINEAR BRIM SEGMENTS AND MEDIAL SEALING BEADS

CLAIM FOR PRIORITY

This non-provisional application is a continuation of U.S. patent application Ser. No. 10/751,786 entitled "Lidded Container with Linear Brim Segments and Medial Sealing Beads," filed Jan. 5, 2004, which is a continuation-in-part of U.S. patent application Ser. No. 10/456,207 entitled "Separable Containers Arranged in Arrays With Integrally Formed Lids," filed on Jun. 6, 2003, the priority of which is claimed. This application also claims the benefit of the filing date of U.S. Provisional Patent Application Ser. No. 60/389,533, filed Jun. 18, 2002.

BACKGROUND

Plastic containers with lids such as disposable plastic containers are well known. There is disclosed in U.S. Pat. No. 5,702,017 to Goncalves a combination of a row of containers and a strip of caps, each of the containers and caps being respectively joined by breakable links allowing the joined strip of caps to be placed on necks of the joined row of containers by a translational movement parallel to the axes of the containers. See also U.S. Pat. No. 5,531,349 of Wojcik et al.; French patents 2 763 314 of APRI and 1 278 149 of GOIFFON.

Disposable articles are used as food containers as is seen, for example, in U.S. Pat. No. 5.012,971 to Cozzi et al. In the '971 patent there is disclosed a compartmented container of the "clam shell" class suitable for containing food. The container or package in one embodiment includes a first or bottom compartment and a second or top compartment that is hinged to the first compartment. There is disclosed in U.S. Pat. No. 4,798,133 to Johnson a package and container for eggs. The container defines a plurality of compartments each of a configuration to hold an egg captive, each portion of the container defining a respective single compartment being connected with the remainder along lines of weakening, perforation or the like.

Containers arranged in arrays with breakable or tearable portions between them are seen in a number of references. In this respect, German Patent DE 100 12 364 of on der Worth discloses separable egg cartons arranged in a planar array.

There is disclosed in U.S. Pat. No. 6,000,535 to Berk et al. disposable mixing wells. Wells are formed as a unitary sheet of individual mixing wells arranged in rows and columns The boundary between each mixing well is scored, perforated or otherwise made to allow individual pieces to be removed from the sheet. Preferably the mixing wells may be pressure formed rather than being vacuum formed.

There is disclosed in U.S. Pat. No. 5,904,263 to St. Pierre et al. a multi-container package with individually removable containers. The package includes several individually sealed containers which are easily separable from one another by weakened zones between adjacent containers. Each container includes a tab portion over which the peel tab of the lid extends. Dimples in either the peel tab or tab portion facilitate their separation. Several multi-container packages are manufactured as a unit using a die and conventional heat sealing process and then are separated from one another by transverse cuts.

U.S. Pat. No. 5,409,127 to Stratford et al. is directed to a multi-pack container assembly. The multi-pack assembly includes a plurality of containers and webs joining the containers, each web configured to include an area of reduced structural integrity for tearing a plurality of frangible ribs interconnecting adjacent containers and traversing the tearing area.

U.S. Pat. No. 4,875,620 to tone, Sr. discloses a fluted product cup. The cup, suitable for food packaging is formed from a resilient material and has an integral body having a product reservoir and a lip. The product reservoir includes a flat bottom wall and a continuous sidewall integrally joined together about a smooth curve. The sidewall extends upwardly from the bottom wall to join the lip. The joint between the lip and the sidewall continuously surrounds and defines an opening through the lip to the interior of the reservoir. The lip extends in a plane outwardly from this opening completely around the periphery of this opening. The bottom wall is essentially circular in shape and the opening is essentially a square shape. First, second, third and fourth fluted areas are located in the sidewall at the corners of the squarish shaped opening at the top of the containers. Each of the fluted areas are shaped essentially as a conical surface generated from a cone which is truncated by a plane about a parabolic intersection of the plane with the cone. These containers may be formed in an array as can be seen in the patent.

With respect to containers which may be separated, the following references are also of interest: French Patent No. 1,392,947 to Skandinavisk; German Patent No. DE 26 53 906 to Gizeh-Werk and British Provisional Specification No. 649, 541 to Stephenson.

It is seen in U.S. Pat. No. 5,722,553 to Hovatter an integral assembly of microcentrifuge strip tubes having independently tethered caps and angularly related seal caps.

Food containers having sealing features are likewise well known. In this respect, ridges and cooperating grooves are used in many such containers. See U.S. Pat. No. 5.377,860 to Littlejohn et at The above applications, publications and patents are incorporated herein by reference.

While the container art is plentiful, there remain largely unresolved issues with respect to lidded containers of low cost that can exhibit superior sealing characteristics, even at low product weight. This is especially so with respect to containers having straight brim segments. Simply making a "tighter" fit between the lid and its associated container or receptacle is ineffective since the increase in the required capping force will crush the container, leading to product failure in too many instances as well as associated spillage.

SUMMARY OF THE INVENTION

There is provided in accordance with a first aspect of the present invention a lidded container including a receptacle portion with a brim having a plurality of lateral, substantially straight brim lateral wall segments extending between corners, which corners link the brim lateral wall segments; a lid adapted to engage the brim is included, wherein the lid likewise includes a plurality of lateral, substantially straight lid wall segments extending between lid corners The improvement of the present invention provides a plurality of medial sealing beads disposed on the substantially straight lateral brim wall segments or the substantially straight lateral lid wall segments, the medial sealing beads being characterized in that (i) the medial sealing beads project away from their respective walls a maximum distance at a central portion thereof between and distal to the corners with lesser projections away from their lateral walls at their portions proximate to the corners and (ii) the medial sealing beads extend over the major portion of the length of the lateral wall segment upon which they are disposed. Preferably, the beads terminate at or prior to the corners at either end of the wall segment. By "major portion" it is meant that the sealing beads extend over more than 50% of the length of the straight wall segment. The unique geometry of the present invention provides enhanced sealing, yet does not substantially increase the cap force required to close the container, such that it is especially useful for thermoformed, disposable containers.

There is thus provided in a preferred embodiment the addition of a male bead along the straight side of a square (with round corners) soufflé container (hereinafter referred to as the cup) brim. This product may be produced in a six-pack design as is shown herein to be separated by the end user. A six-pack design is especially suitable for 2-ounce containers, while the inventive product may likewise be produced in a four-pack design which is especially suitable for 4-ounce containers. The lid bead seal improvement achieved by way of the medial sealing bead is not limited to these configurations. The lid bead seal can be employed in connection with a wide variety of containers as described and claimed herein. The invention is perhaps most preferably incorporated into a bead of semicircular cross section or profile as is shown in FIG. 4 approximately one third the distance down from the top of the brim when viewed from the top of the cup. The bead is at its fullest protrusion or projection at the center line of the straight side of the cup and runs tangent to the corner radii on either side. The height of the bead is most preferably 0.008 inches in the embodiments tested, progressively diminishing or feathering out to 0.000 at a tangency of the corner radius. That is to say, the highest point of the 0.008 arc attains a crown on the center line of the cup when viewed from the top and tapers to the tangent point of the corner on both ends of the arc as is best appreciated from FIG. 3. Without intending to be bound by any theory, it is believed that the cup bead feature performs the sealing function because it increases pressure between the lid and cup brim when it is normally at its lowest; that is, in the center of the flat sides. The flat sides of the square cup or container are difficult to seal due to the lack of pressure or contact along the flat side of the brim. Simply reducing the size of the lids distorts the cup and causes the brim to buckle and makes capping difficult. Because the bead provides a point of contact and exerts pressure exactly where it is needed, leak resistance is greatly improved with minimal increase of capping force. The bead also acts as a strengthening rib to prevent buckling of the brim. The test data hereinafter included of improved leak resistance is in fact dramatically achieved without increasing the capping force required to seal the container.

In another aspect of the present invention, there is provided a lidded container including a receptacle portion having (i) a bottom portion and (ii) a sidewall portion defining (iii) an upper aperture. The receptacle portion is further provided with a brim extending around the upper aperture the brim including (i) a plurality of rounded corner brim portions and (ii) a plurality of lateral brim walls extending between the rounded brim corner portions, the walls being configured such that their surfaces are substantially linear along a direction between adjacent brim corners interconnected thereby. A lid is adapted to engage the brim and together with the receptacle portion and its brim define a sealed container, the lid is suitably provided with (i) a plurality of lid rounded corner portions and (ii) a plurality of lateral lid walls extending between lid rounded corner portions wherein the lid rounded corner portions and the lateral lid walls are configured to engage the corresponding brim corner portions and lateral brim walls, the lateral lid walls likewise being configured such that their surfaces are substantially linear between adjacent lid corner portions interconnected thereby. There is further provided a plurality of medial sealing beads disposed on lateral walls selected from the lateral brim walls and the lateral lid walls, the medial sealing beads being characterized as noted above.

Most preferably, the lidded container according to the present invention is thermoformed from a plastic material. Such materials may include polystyrene polymer compositions, such as high impact polystyrenes or rubberized polystyrene. Further polystyrenes contemplated for use in connection with the present invention include oriented polystyrene. Alternatively, the inventive containers maybe made from a thermoplastic composition including a polyolefin polymer such as polypropylene or polyethylene. Still further suitable materials include polyester materials such as a thermoplastic composition including polyethylene terephthalate.

Instead of being made by way of thermoforming, the inventive containers may be made by injection molding if so desired. Typically, in a preferred embodiment the container has a fill volume of from about 1 to about 8 fluid ounces, such as from about 1 to about 4 fluid ounces. In the embodiments specifically illustrated hereinafter, the containers have a fill volume of about 2 fluid ounces and are particularly useful for condiments.

The lidded containers may include a U-shaped rim on the receptacle and a corresponding U-shaped channel in the lid The plurality of medial sealing beads most preferably extends over substantially the entire distance between rounded corners and defines an arched line therebetween. The medial sealing beads most preferably blend with the rounded corners such as in preferred embodiments where the medial sealing beads are tangent with the rounded corners at their end portions. In particularly preferred embodiments, the medial sealing beads have an arched profile away from the lateral walls upon which they are disposed and the lateral walls are generally planar. Likewise in a particularly preferred embodiment the lateral walls upon which the sealing beads are disposed have an upper portion and a lower portion and the medial sealing beads are located proximate to the upper portions of the lateral walls on which they are disposed such as where the sealing beads are disposed at substantially two-thirds the height of the lateral wall. In such cases the medial sealing beads may have a maximum projection away from its lateral wall at substantially the center line of the lateral wall.

A particularly preferred container is a thermoformed disposable lidded container comprising a substantially generally rectangular receptacle portion having (i) a bottom and (ii) a side wall defining (iii) an upper aperture, the receptacle portion being further provided with a rectangular brim extending around the upper aperture the brim including (i) a U-shaped profile portion defining (ii) a plurality of rounded corner brim portions and (iii) a plurality of outer lateral brim walls extending between the rounded brim corner portions. The outer brim walls are configured such that their surfaces are substantially linear along a direction between adjacent brim corner portions interconnected thereby. The container also has a lid having (i) a rectangular sealing channel with rounded corners adapted to fit over the brim thereby forming a sealed container with the receptacle portion. The outer lateral brim walls are provided with a plurality of medial sealing beads characterized in that (i) the medial sealing beads project away from the respective outer lateral brim walls the maximum distance at a center portion thereof between and distal to the corners, with lesser projections away from the outer lateral brim wall at its end portions proximate to the corners and (ii) the medial sealing beads extend over the major portion of the length of the outer brim wall upon which it is disposed been adjacent corners. Most preferably each lateral brim wall is provided with a medial sealing bead and the lids are hinged to the receptacle.

In preferred aspects of the invention, there are provided integrally formed ensembles of interconnected and separable containers each of which includes an associated lid as described and illustrated hereinafter. In these embodiments the lids are generally co-planar with the upper aperture of their associated cups and the containers are separably joined to one another by tearable portions which are scored and/or perforated. Preferably the lids are hinged to their associated cups by way of a perforate and/or scored hinged portion of the integrally formed ensemble and the containers are likewise separately joined by tearable portions that are scored. Most preferably the lids are generally planar while the cups are of substantial depth. For example, the cup may have a depth of an inch and a quarter or so while the lid would have an overall thickness of less than ¼ inch.

BRIEF DESCRIPTION OF DRAWINGS

The invention is described in detail below with reference to the drawings, wherein like numerals designate similar parts and wherein.

DETAILED DESCRIPTION

The invention is described in detail below with reference to several embodiments. Modifications of those embodiments within the spirit and scope of the present invention, set forth in the appended claims, will be readily apparent to those of skill in the art.

Figure 1:
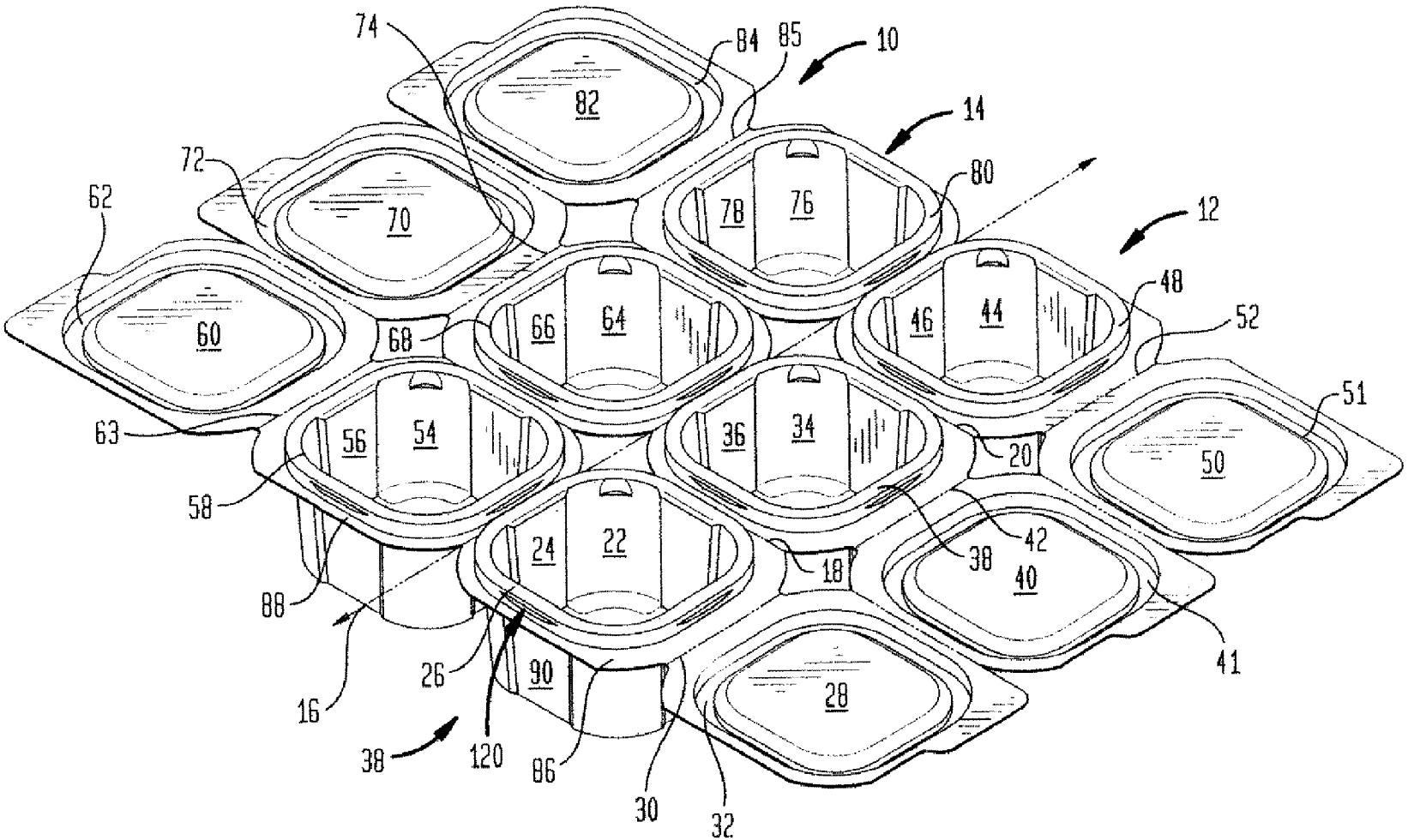
FIG. 1 is a view in perspective of an integrally thermoformed container lid ensemble constructed in accordance with the present invention.

Referring to FIG. 1, there is shown an ensemble 10 of integrally formed separable containers including a first array 12 of containers and a second array 14 of containers arranged on either side of a medial axis 16. The containers are separably joined to one another by a plurality of tear portions indicated by dashed lines such as portions 15, 20. The tear portions may be scored portions and are most preferably scored perforated portions.

First array 12 of containers includes a receptacle or cup 22 having an upper aperture 24 as well as a rectangular brim 26. A lid 28 is hingedly coupled to cup 22 by way of scored hinge portion 30 which is preferably a perforate scored portion as well. Lid 28 also has a channel 32 with a rectangular profile which cooperates with brim 26 (which also has a rectangular profile) to form a closed container. That is to say, upon pivotal motion of lid 28 about hinge portion 30, the lidded container including cup 22 and lid 28 forms a sealed container when the lid is secured to the brim.

Figure 4:
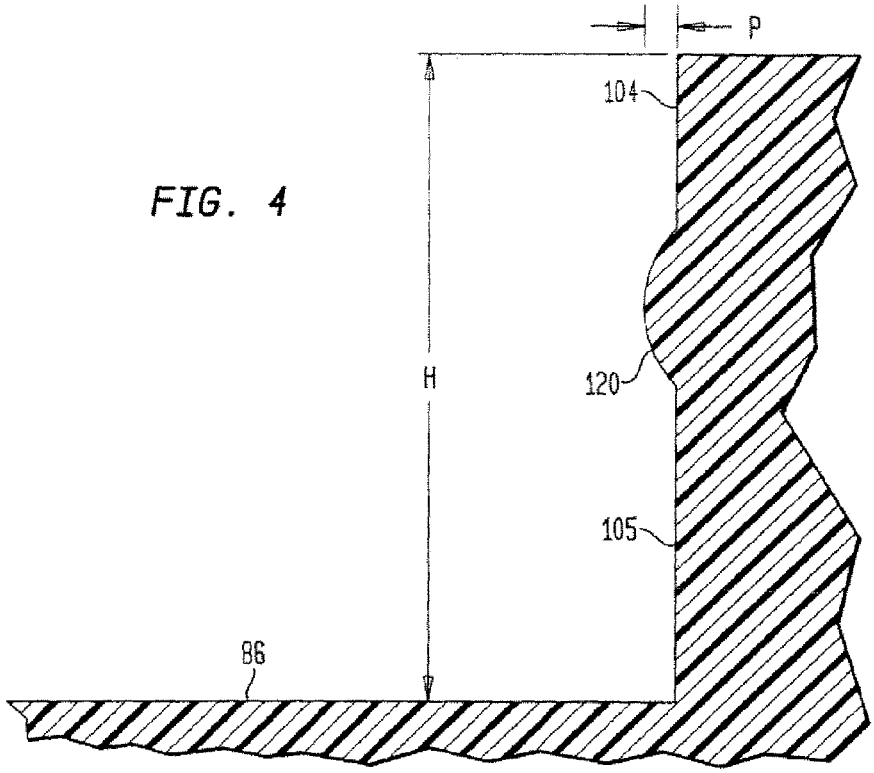
FIG. 4 is an enlarged schematic view illustrating the profile of the medial sealing bead.
Figure 5:
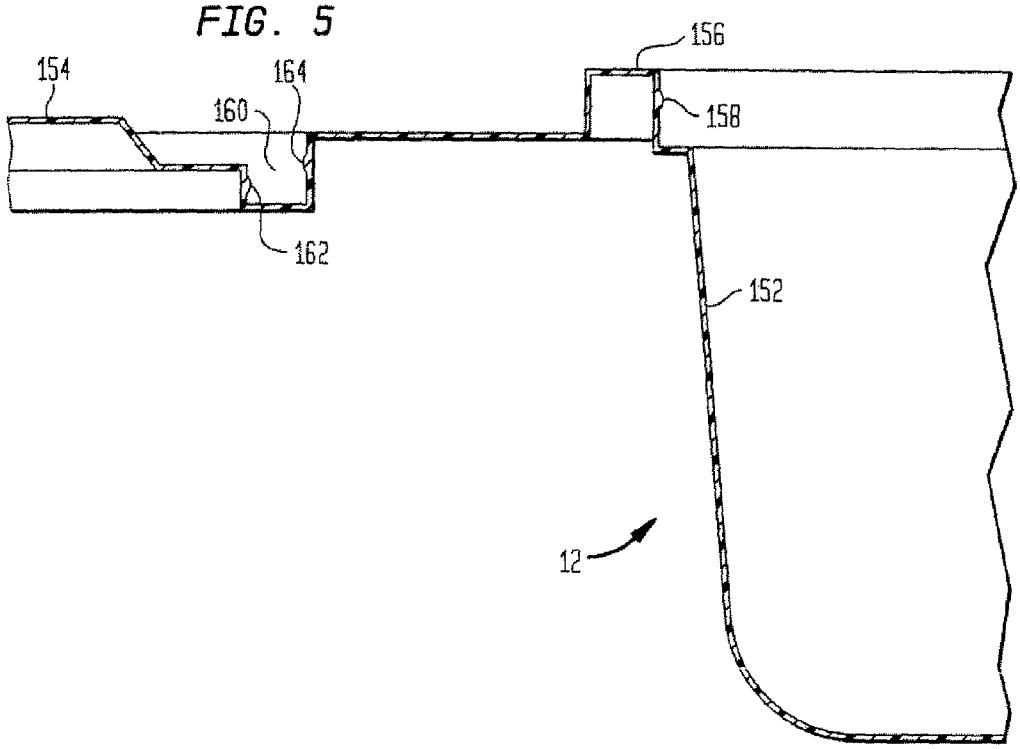
FIG. 5 is a schematic view of a single container in profile illustrating alternate locations of medial sealing beads.

The profiles of lid 28 and brim 26 of cup 22 are likewise seen in FIG. 5. FIG. 5 has the same container shape as are seen in FIGS. 1-4 except that the sealing beads are shown at alternative locations, discussed further below.

Referring again to FIG. 1, it is seen that array 12 also includes a cup 34 with an upper aperture 36 and a brim 38 as well as a lid 40 with a channel 41 secured to cup 34 by way of hinge 42. Still further included in array 12 is a third container including cup 44 with upper aperture 46, brim 48, lid 50 with a channel 51 secured by way of hinge 52.

Second array 14 of sealable containers includes: (i) a cup 54 with an upper aperture 56 and brim 58, lid 60 with channel 62 and a hinge 63; (ii) a cup 64 with an upper aperture 66, brim 68, lid 70 with a channel 72 and a hinge 74; and (iii) cup 76 with an upper aperture 78 and a brim 80, lid 82 with a channel 84 attached to cup 76 by way of hinge 85.

Each of the cups and lids 34-82 has the features of cup 22 and lid 28, discussed in more detail below. For example, the channels 32, 41 and so on have the shape shown schematically in FIG. 5, except that in FIGS. 1-4 the sealing beads are shown on the outer lateral walls of the sealing brim. Preferably the channels, such as channel 32, 41, 51 and so forth, have a U-shaped profile as do the brims such as brims 26, 38, 48 and so forth, as shown in FIGS. 1 and 5. Note in FIGS. 1 and 5 the brims and channels have U-shaped profiles provided with flat inner and outer walls, except where the sealing bead is formed. Hinges, such as hinges 30 and 42 are also scored as shown by the dotted lines in FIG. 1 and may also be perforate scored if so desired. Each receptacle portion or cup also has a surround such as surround 86 and surround 88 located outside the brim on its lower edge as is seen in FIG. 1 and perhaps better appreciated from FIGS. 2 and 3 where the shaped construction of the sidewalls of the receptacle portion of the containers is likewise appreciated. That is to say the rounded corners of the containers as well as the recessed sidewalls 90 of the various cups may also be seen.

As will be appreciated from FIGS. 1 through 5, each container includes a cup or receptacle portion as well as an associated lid. The receptacle portions have a brim with a plurality of straight portions between rounded corners as will be particularly appreciated by reference to FIGS. 2 and 3.

Figure 2:
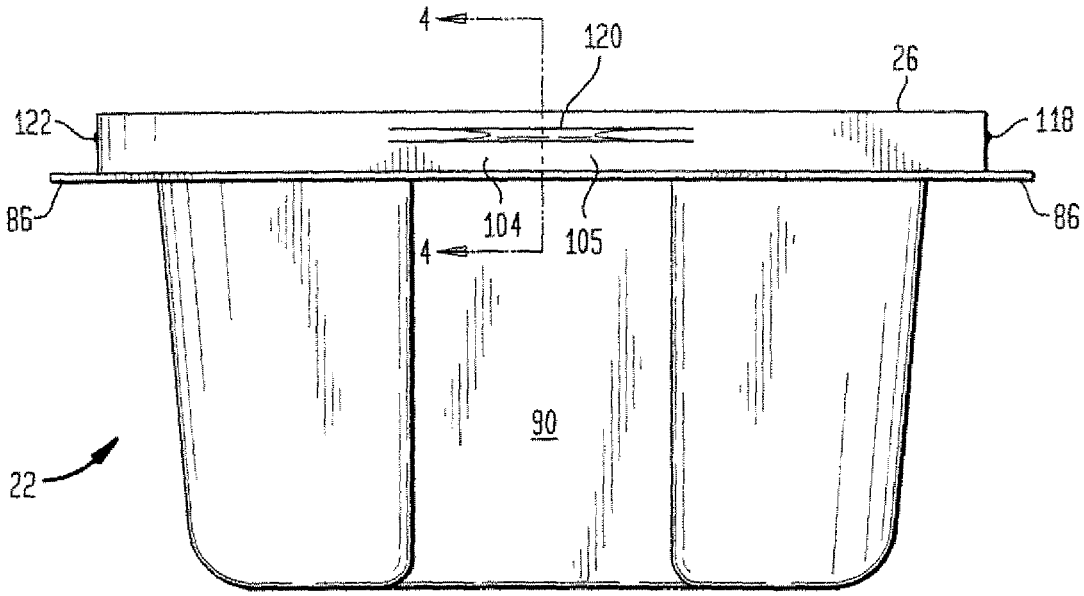
FIG. 2 is a view in elevation of a receptacle of the present invention provided with a medial sealing bead about the four (4) straight portions of its brim.
Figure 3:
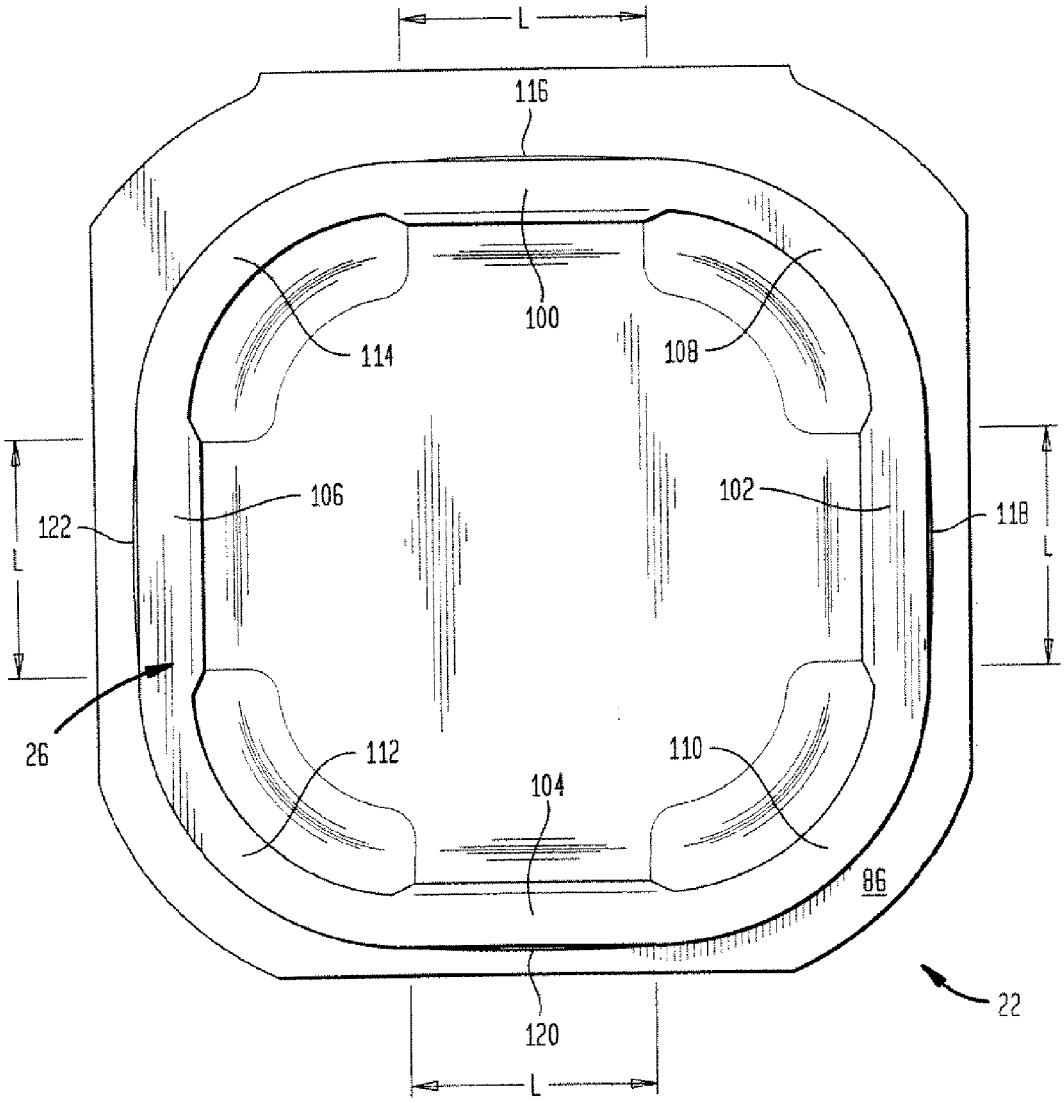
FIG. 3 is a top view of a receptacle of the present invention provided with medial sealing beads.

FIG. 2 is a partial view in elevation of a portion of a container of FIG. 1 including receptacle or cup 22 while FIG. 3 is a top plan view thereof. Receptacle portion 22 has a brim 26 provided with four linear segments 100, 102, 104, and 106. The linear segments are interconnected by rounded corners 108, 110, 112, and 114. Preferably the brim is U-shaped in profile as shown with generally flat (except for sealing beads) inner and outer sidewalls which define a U-shape together with its top. Likewise, the channels are most preferably U-shaped with flat walls cooperating to form a seal with the rectangular, U-shaped brim when the parts are engaged. Each of the linear segments 100, 102, 104 and 106 of the brim has a medial sealing bead, 116, 118, 120, and 122 as shown extending substantially over the entire length, L, of the linear segment and blending with the corners between the linear segments. Most preferably, the medial sealing beads are arched in shape as shown and tangent to the corner portions of the brim and are configured such that they generally progressively increase in projection from the walls of the brim as the distance from the adjacent corner portions increases. That is to say, the sealing beads project away from the brim a maximum distance at the center portion of the linear segment where they are disposed. This feature is perhaps best appreciated by reference to FIGS. 2 and 4. FIG. 4 is an enlarged schematic view in section along line 4-4 of FIG. 2, that is, at the center point of linear segment 104. Here the sealing bead 120 has its maximum projection which is shown as its maximum projection, P, away from surface 105 of brim segment 104 which may be about 8 mils (thousandths of an inch) or so for a two ounce container. In the embodiment shown in FIGS.

1 through 4, the bead is disposed at a height which is approximately two-thirds the height, H, of brim portion 104 above surround 86. Other positions of sealing beads are possible. That is to say, the sealing bead is located on wall 105 of brim portion 104 as shown in the diagram. The beads are in the same location on all straight segments of the brims on the containers shown in FIG. 1, as will be appreciated from FIGS. 2 and 3, especially.

There is shown schematically in FIG. 5 alternate locations of sealing beads of the present invention.

FIG. 5 illustrates a container including a cup portion 152 as well as a lid 154. The cup portion has a brim 156 which might include a sealing bead on its inner wall as indicated at 158 instead of on the outer wall as in shown in FIGS. 1 through 4. Likewise, lid 154 may include a channel 160 provided with sealing beads on its inner wall as indicated at 162 and/or on its outer wall as indicated at 164. It is believed that the embodiment shown in FIGS. 1 through 4 is preferable for many containers of the present invention; however, the beads as described herein may be suitably located at one or more locations as is shown in FIG. 5.

The length of the maximum projection, P, away from the sidewall of the brim upon which the medial sealing bead is disposed has an impact on the seal improvement for the container. It is found in accordance with the present invention, that a seal with a maximum projection of 8 mils performed substantially better than a seal having a maximum of 0.005 inches or 5 mils. It is seen in the vinegar/oil leak test the percent pass for the 8 mil bead was 96 percent while only 46 percent of the 5 mil bead containers passed, suggesting that the projection distance impacts performance. Thus, if one looks at FIG. 3 the linear length, L, of a straight portion of the brim may be for example one inch or so for a two ounce container where the optimal projection length away from the sidewall of the brim may be about 8 mils. Thus suitably a preferred ratio of P/L is preferably from about 0.01 to about 0.0075. That is to say, for a one inch straight sidewall length the projection should be from about 7.5 to 10 mils or so. In other embodiments preferred P/L ratios may vary. For example, P/L ratios of from about 0.0025 to about 0.025 are within the scope of the invention as are P/L ratios of from about 0.005 to about 0.015.

The integrally formed, container/lid arrays of the present invention may be conveniently formed by way of any conventional molding technique from a plastic material such as by a thermoforming process from a suitable thermoplastic sheet. "Thermoforming", "thermoformed" and like terminology is given its ordinary meaning. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist pressure bubble immersion, trapped sheet, slip, diaphragm, twin-sheet cut sheet, twin-sheet roll-fed forming or any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap. In some preferred embodiments, the melt-compounded composition from which the articles are made may include polypropylene and optionally further includes a polyethylene component and titanium dioxide. Suitable materials and techniques for fabricating the disposable containers of the present invention from thermoplastic materials appear in U.S. Pat. No. 6,211,501 to McCarthy et al. as well as U.S. Pat. No. 6.211,500 to Cochran II et al the disclosures of which are incorporated herein by reference. When thermoformed, the containers are made from sheet having a caliper of from bout 5 to 30 mils; typically from about 10 to 20 mils.

Alternatively, the lid/container ensemble may be injection molded; however, thermoforming is generally preferred.

The present invention provides a unique combination of leak resistance and ease of capping. This latter feature is very important especially for thermoformed articles which tend to crush if the capping force required is too high. This will be appreciated from the discussion which follows.

Product Testing

Products were tested for water or vinegar/oil leakage as follows: (a) with the containers still inter-connected and with their lids still connected, they were filled with water or a 50/50 mixture of vinegar and vegetable oil; (b) the containers were then closed; (c) the containers were then separated from one another and placed on blotter paper; (d) each container was then placed on a side thereof, the side selected not having a hinge or tab; (e) the container was allowed to remain on its side for up to ten minutes; (f) if the container did not leak in 10 minutes, it was recorded as a pass; all others were recorded as failures; and (g) the test was repeated for another container ensemble, but the containers were placed on their sides opposite to those of the first trial.

The capping force test was conducted as follows: (a) with the container uncapped, they were separated from six-pack units, care was taken not to tear or damage the brim of the receptacle; (b) the test specimen, including receptacle and hinged cap, was placed in an automated capping tester with a preset gauge height sufficient to receive the container without interference; (c) the lid was folded into a capping position while a force gauge was zeroed and the speed set to 2½"/minute; (d) the tester drive was activated and the cross arm advanced until the cap was filly seated on the receptacle; (d) the container was inspected for damage; and (e) the capping force required was recorded.

Initially the containers shown in FIG. 1 were made without medial sealing beads and did not perform well in the leak test. Initial trials involved making the lids tighter; however more than half of these containers were crushed during capping. It was found however, that with a required capping force of four (4) pounds or so, no containers were crushed. The inventive design was conceived and tested after these initial failures. Composite results are shown in Table 1. Table 1 reflects the early approach toward improving leak testing by making a tighter cap, but as can be seen from Table 1 this resulted in an unacceptably high rate of crushing of the container during capping. More importantly, it is seen from the data that with the present invention the containers are remarkably more leak resistant.

TABLE 1

| Leak/Cap Testing | | | | | | | |
|---|---|---|---|---|---|---|---|
| | Water Leak (% Pass) | Vinegar/ Oil Leak (% Pass) | Capping Force with Hinge (lb.) | % Crushed When Capped with Hinge | Capping Force without Hinge (lb.) | % Crushed When Capped without Hinge | Avg 6 Pack Weight (grams) |
| Invention Tooling | 100% | 71% | 4.8 | — | 4.4 | — | 31.694 |
| Tooling A Without Sealing Bead | 0% | 0% | 8.5 | 58% | 8.2 | 58% | 29.759 |
| Tooling B Without Sealing Bead | 75% | 0% | 4.1 | — | 4.3 | — | 29.870 |

| | Vinegar/Oil Leak Breakdown |
|---|---|
| % Pass (0.008" Bead) | 96% |
| % Pass (0.005" Bead) | 46% |

In Table 1 there is seen a dramatic increase in leak resistance with the invention design, without the need for an increase capping force and associated crushing of the containers.

What is claimed is:

1. A container, comprising:

a) a cup having a brim comprising a plurality of lateral, substantially straight brim wall segments extending between a plurality of brim corners that link the brim wall segments, wherein the brim is U-shaped;

b) a lid adapted to engage the brim, wherein the lid comprises a plurality of lateral, substantially straight lid wall segments extending between a plurality of lid corners, wherein the lid has a U-shaped channel engageable with the U-shaped brim; and c) a plurality of medial sealing beads disposed on the brim wall segments, wherein the medial sealing beads:

i) project away from the respective brim wall segments a maximum distance at a central portion thereof, thereby defining an arched profile between adjacent brim corners; and ii) extend over a major portion of the length of the brim wall segment upon which they are disposed, wherein the container is leak resistant when the brim is engaged with the lid.

2. The container of claim 1, wherein the container is made from a thermoplastic composition comprising polystyrene.

3. The container of claim 1, wherein the container is made from a thermoplastic composition comprising one or more polyolefins.

4. The container of claim 1, wherein the lid and the cup are injection molded.

5. The container of claim 1, wherein prior to sealing the container, the container is arranged in an ensemble comprising a plurality of cups and a plurality of associated lids, wherein the associated lids are hingedly coupled to a plurality of tear portions.

6. A container, comprising:

a cup having a brim comprising a plurality of lateral, substantially straight brim wall segments extending between a plurality of brim corners adapted to connect the brim wall segments, wherein the brim is U-shaped;

a lid comprising a plurality of lateral, substantially straight lid wall segments extending between a plurality of lid corners and defining a U-shaped channel engageable with the U-shaped brim of the cup; and a plurality of medial sealing beads disposed on both the brim wall segments and the lid wall segments, wherein the medial sealing beads:

project away from the brim wall and lid wall segments a maximum distance at a central portion thereof, thereby defining an arched profile between adjacent brim corners and lid corners; and extend over a major portion of the length of the lateral wall segment upon which the medial sealing beads are disposed.

7. The container of claim 6, wherein the arched profile progressively increases in projection from the brim wall and lid wall segments as the distance from the adjacent brim corners and lid corners increases.

8. The container of claim 6, wherein the lid and the cup are injection molded.

9. The container of claim 6, wherein the lid and the cup are thermoformed.

10. The container of claim 6, wherein prior to sealing the container, the container is arranged in an ensemble comprising a plurality of cups and a plurality of associated lids, wherein the associated lids are hingedly coupled to the cups by tear portions.

11. A container ensemble, comprising:

a plurality of cups, each having a brim comprising a plurality of lateral, substantially straight brim wall segments extending between a plurality of brim corners adapted to connect the brim wall segments, wherein the brim is U-shaped;

a medial sealing bead disposed on each brim wall segment, wherein the medial sealing bead projects away from a respective brim wall a maximum distance at a central portion thereof, thereby defining an arched profile between adjacent brim corners; and a plurality of lids, each hingedly coupled to an associated cup prior to sealing the container ensemble, wherein each lid comprises a plurality of lateral, substantially straight lid wall segments extending between a plurality of lid corners and defining a U-shaped channel engageable with the U-shaped brim.

12. The container ensemble of claim 11, wherein the plurality of lids is hingedly coupled to the cups by tear portions.

13. The container ensemble of claim 11, wherein the arched profile progressively increases in projection from the brim wall segment as the distance from the adjacent brim corners increases.

14. The container ensemble of claim 11, wherein the container ensemble is thermoformed.

15. The container ensemble of claim 11, wherein the container ensemble is injection molded.

16. A container ensemble, comprising:

a plurality of cups, each having a brim comprising a plurality of lateral, substantially straight brim wall segments extending between a plurality of brim corners adapted to connect the brim wall segments, wherein the brim is U-shaped;

a plurality of lids, each hingedly coupled to an associated cup prior to sealing the container ensemble, wherein each lid comprises a plurality of lateral, substantially straight lid wall segments extending between a plurality of lid corners and defining a U-shaped channel engageable with the U-shaped brim; and a medial sealing bead disposed on each lid wall segment, wherein the medial sealing bead projects away from a respective lid wall a maximum distance at a central portion thereof, thereby defining an arched profile between adjacent lid corners.

17. The container ensemble of claim 16, wherein the arched profile progressively increases in projection from each lid wall segment as the distance from the adjacent lid corners increases.

* * * * *